US009774102B2

(12) United States Patent
Genta et al.

(10) Patent No.: US 9,774,102 B2
(45) Date of Patent: Sep. 26, 2017

(54) CONNECTOR FOR MAGNETIC COIL

(71) Applicant: Tyco Electronics AMP Italia S.R.L., Turin (IT)

(72) Inventors: Alessandro Genta, Alipgnano (IT); Marco Barberis, Turin (IT); Marcello Farinola, Rivoli (IT)

(73) Assignee: Tyco Electronics AMP Italia S.R.L., Turin (IT)

( * ) Notice: Subject to any disclaimer, the term of this patent is extended or adjusted under 35 U.S.C. 154(b) by 0 days.

(21) Appl. No.: 15/404,781

(22) Filed: Jan. 12, 2017

(65) Prior Publication Data

US 2017/0207550 A1 Jul. 20, 2017

(30) Foreign Application Priority Data

Jan. 14, 2016 (IT) ..... 102016000002972

(51) Int. Cl.
*H01R 4/24* (2006.01)
*H01R 4/28* (2006.01)
*H01R 13/24* (2006.01)

(52) U.S. Cl.
CPC ..... *H01R 4/24* (2013.01); *H01R 4/28* (2013.01); *H01R 13/2407* (2013.01)

(58) Field of Classification Search
CPC ..... H01R 4/24; H01R 4/2404; H01R 4/2416; H01R 4/2466
See application file for complete search history.

(56) References Cited

U.S. PATENT DOCUMENTS

2006/0097834 A1 5/2006 Lerchenmueller et al.
2010/0068915 A1 3/2010 Kahl

OTHER PUBLICATIONS

Italian Written Opinion, dated Aug. 29, 2016, 8 pages.

*Primary Examiner* — Ross Gushi
(74) *Attorney, Agent, or Firm* — Barley Snyder

(57) ABSTRACT

A connector for connecting to a magnetic coil wound onto a support is disclosed. The connector comprises a first resilient body formed of a conductive material and having a plurality of cutters disposed on a plurality of inner walls of the first resilient body. The first resilient body is inserted onto the support and held in an open position during insertion. The first resilient body is biased into a closed position. In the closed position, the plurality of cutters cut an insulating layer on the magnetic coil and the first resilient body retains the magnetic coil on the support while electrically connecting the magnetic coil and the support.

24 Claims, 21 Drawing Sheets a)

30
4
20
1

30
20
20a 4
4b
4e
4a
4e
4b
4b1
4b1

1
1a
1c
1c

CONNECTOR FOR MAGNETIC COIL

CROSS-REFERENCE TO RELATED APPLICATION

This application claims the benefit of the filing date under 35 U.S.C. §119(a)-(d) of Italian Patent Application No. 102016000002972, filed on Jan. 14, 2016.

FIELD OF THE INVENTION

The present invention relates to an electric connector, and more particularly, to an electric connector for connection to a magnetic coil.

BACKGROUND

In the prior art, a magnetic coil is formed by winding a magnetic cable around a support. After a layer of insulating enamel covering the magnetic cable is partially removed, the cable is welded to the support.

The tendency in the prior art is to reduce the cross-section of the cable so as to increase the number of turns that compose the coil. Due the increasingly small dimensions of the cable, however, the known technique of welding the cable to the support increasingly leads to the cable catching fire or not making electrical contact if the cable is not welded correctly. Furthermore, under severe use conditions, it is possible that mechanical stress such as strong vibrations can break the welds, interrupting the electrical connection.

SUMMARY

An object of the invention, among others, is to provide a connector connecting a coil and a support which has a simple and inexpensive structure yet can be used even in the most severe applications. The disclosed connector comprises a first resilient body formed of a conductive material and having a plurality of cutters disposed on a plurality of inner walls of the first resilient body. The first resilient body is inserted onto the support and held in an open position during insertion. The first resilient body is biased into a closed position. In the closed position, the plurality of cutters cut an insulating layer on the coil and the first resilient body retains the magnetic coil on the support while electrically connecting the magnetic coil and the support.

BRIEF DESCRIPTION OF THE DRAWINGS

The invention will now be described by way of example with reference to the accompanying Figures, of which:

FIG. 1(*b*) is a perspective view of the connector, the housing, and the tool of FIG. 1(*a*);

FIG. 1(*c*) is a perspective view of the connector, the housing, and the tool of FIG. 1(*a*);

FIG. 1(*d*) is a sectional view of the connector, the housing, and the tool of FIG. 1(*a*);

FIG. 2(*b*) is a perspective view of a resilient body according to an embodiment of the invention;

FIG. 2(*c*) is a perspective view of a housing and a tool according to an embodiment of the invention;

FIG. 2(*d*) is a sectional view of the connector, the resilient body, the housing, and the tool of FIG. 2;

FIG. 3A(b) is a perspective view of a first resilient body of the connector of FIG. 3A(a);

FIG. 3A(c) is a perspective view of a second resilient body of the connector of FIG. 3A(a);

FIG. 3A(d) is a perspective view of a tool according to an embodiment of the invention;

FIG. 3A(e) is an exploded view of the tool of FIG. 3A(d);

FIG. 3B(b) is a perspective view of a first resilient body of the connector of FIG. 3B(a);

FIG. 3B(c) is a perspective view of the connector of FIG. 3B;

FIG. 3B(d) is a sectional view of the connector of FIG. 3B;

FIG. 4(*b*) is a perspective view of the connector of FIG. 4(*a*) and a tool according to an embodiment of the invention;

FIG. 5(*b*) is a sectional view of the connector, the resilient body, the housing, and the tool positioned on the support of FIG. 5(*a*);

FIG. 6(*b*) is a sectional view of the connector contacting the support;

FIG. 7(*b*) is a perspective view of the contact between the connector, the resilient body, and the coil;

FIG. 7(*c*) is a sectional view of a contact between the connector, the resilient body, and the coil;

FIG. 8(*b*) is a perspective view of the contact between the connector, the resilient body, and the coil;

FIG. 8(*c*) is a sectional view of a contact between the connector, the resilient body, and the coil;

FIG. 9(*b*) is a perspective view of the connector and the tool of FIG. 3A;

FIG. 9(*c*) is a perspective view of the connector and the tool of FIG. 3A;

FIG. 9(*d*) is a perspective view of the connector and the tool of FIG. 3A;

FIG. 10(*b*) is a perspective view of the connector and the tool of FIG. 3A and a cable;

FIG. 10(*c*) is a perspective view of the connector and the tool of FIG. 3A and the cable;

FIG. 11(*b*) is a sectional view of a contact between the connector and a coil of the cable;

FIG. 11(*c*) is a top view of the contact between the connector and a coil of the cable;

FIG. 11(*d*) is a top view of the contact between the connector and a coil of the cable;

FIG. 12(*b*) is a perspective view of the connector and the tool of FIG. 4;

FIG. 12(*c*) is a perspective view of the connector and the tool of FIG. 4;

FIG. 12(*d*) is a top view of the connector and the tool of FIG. 4;

FIG. 13(*b*) is a perspective view of the connector and the tool of FIG. 4 and the coil;

FIG. 13(*c*) is a perspective view of the connector and the tool of FIG. 4 and the coil;

FIG. 13(*d*) is a perspective view of the connector and the tool of FIG. 4 and the coil;

FIG. 14(*b*) is a perspective view of the connector and the tool of FIG. 4 and the coil;

FIG. 15(*b*) is a perspective view of the contact between the connector of FIG. 4 and the coil; and FIG. 15(*c*) is a top view of the contact between the connector of FIG. 4 and the coil.

DETAILED DESCRIPTION OF THE EMBODIMENT(S)

Figure 1B:
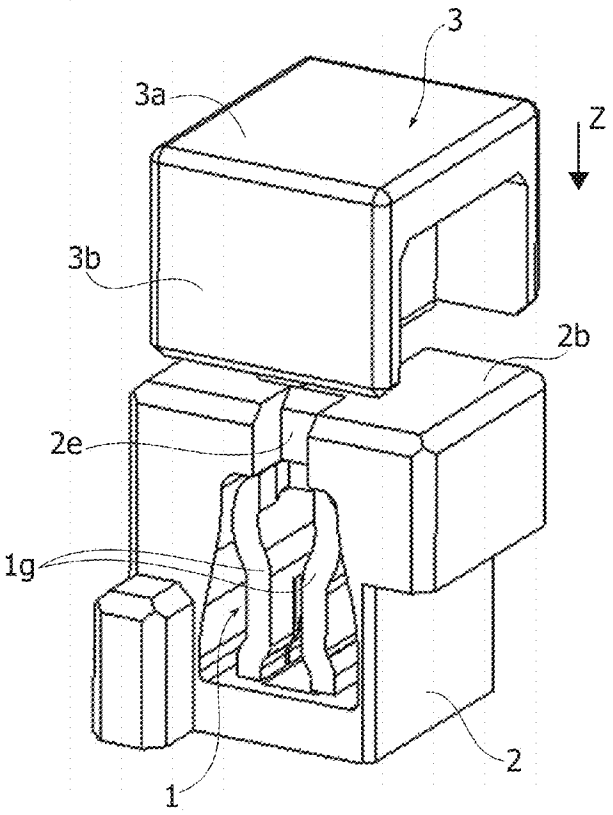
FIG. 1(*a*) is an exploded perspective view of a connector, a housing, and a tool according to an embodiment of the invention.
Figure 1A:
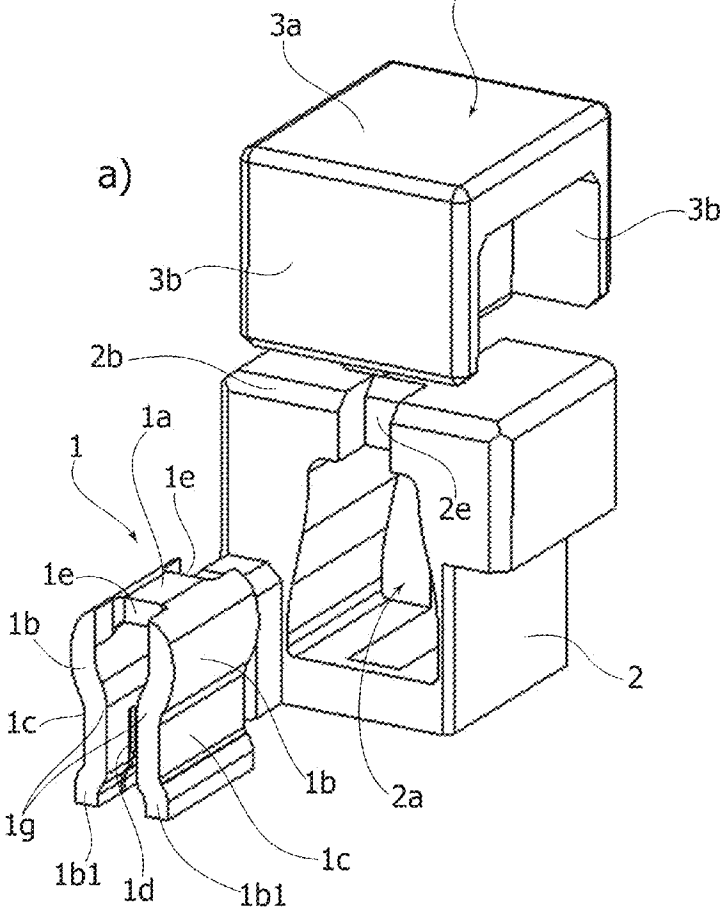
Figure 1D:
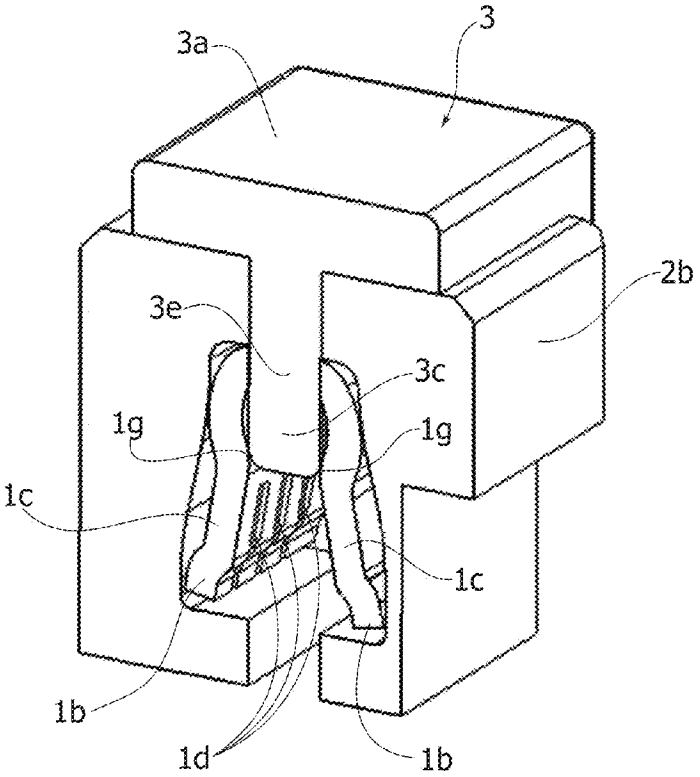
Figure 1C:
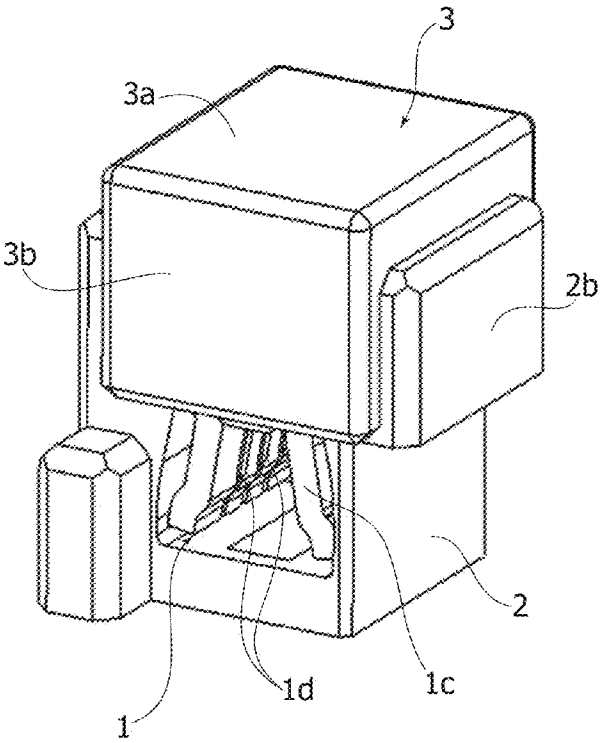

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

A connector 1 according to an embodiment of the invention is shown in FIG. 1. As shown in FIG. 1, the connector 1 is a resilient body 1 with a substantially U-shaped form having a connecting portion 1*a* from which two opposite and spaced apart retainer arms 1*b* extend and are connected to each other via the connecting portion 1*a*. The resilient body 1 may be integrally formed from a plate of sheet metal by stamping and forming the plate of sheet metal.

Each arm 1*b*, as shown in FIG. 1, has a central portion 1*c* projecting towards the other arm 1*b* to reduce the distance between the two arms 1*b*, defining a portion that comes into contact with a coil. An end portion 1*b*1 of each of the arms 1*b* is slightly arched outwards to facilitate moving the arms 1*b* apart manually, the end portions 1*b*1 defining a grip portion for the operator.

Cutters 1*d* are disposed on an inner wall of a central portion 1*c* of each arm 1*b* and extend in a direction orthogonal to a longitudinal direction of the resilient body 1. Each cutter 1*d* may be a longitudinal blade, and the plurality of cutters 1*d* may be disposed parallel to one another. Each cutter 1*d* may be formed by a broaching process. Each cutter 1*d* may alternatively be formed by milling or plastic deformation of the resilient body 1 such as via die-molding.

The connecting portion 1*a* has a reduced longitudinal dimension with respect to the dimension of the arms 1*b* as the resilient body 1 has two seats 1*e* disposed diametrically opposite the connection portion 1*a*. Each arm 1*b* also has an upper portion 1*g* connecting the connecting portion 1*a* to the central portion 1*c* of the arm 1*b*.

The resilient body 1, as shown in FIG. 1, is inserted into a housing 2 and a tool 3 is used to bring the resilient body 1 into an open position. FIGS. 1(*b*), 1(*c*), and 1(*d*) show different steps of an assembly of the resilient body 1 within the housing 2.

The housing 2, as shown in FIG. 1(*b*), has a connector receiving space 2*a* for receiving the resilient body 1 both in a closed and in the open position of the resilient body 1. The connector receiving space 2*a* is conformed so as to leave the necessary space for complete opening of the resilient body 1. The housing 2 also has two seats 2*e* formed on an upper wall 2*d* of the housing 2 and in a position corresponding to the seats 1*e* of the resilient body 1.

The tool 3 brings the resilient body 1 into its open position, as shown in FIGS. 1(*c*) and 1(*d*). The tool 3 is inserted on the housing 2 and is slid downwards in the direction Z shown in FIG. 1(*b*) to open the resilient body 1. The tool 3 has a box shape and comprises an upper wall 3*a* and two lateral walls 3*b*. Within the space defined by the walls 3*a* and 3*b*, two pins 3*e* extend downwards and are adapted to slide in the seats 1*e*, 2*e*. Free ends 3*c* of the pins 3*e* have a tapered shape and enter into engagement with the upper portions 1*g*, moving the upper portions 1*g* and connected end portions 1*b*1 away from each other.

FIGS. 1(*c*) and 1(*d*) show the resilient body 1 at the end of the step of inserting the tool 3 onto the housing 2. In FIGS. 1(*c*) and 1(*d*), the two arms 1*b* of the resilient body 1 have been moved away from each other due to the insertion of the tool 3, to facilitate the insertion of the resilient body 1 on a magnetic coil B shown in FIG. 5.

Figure 5B:
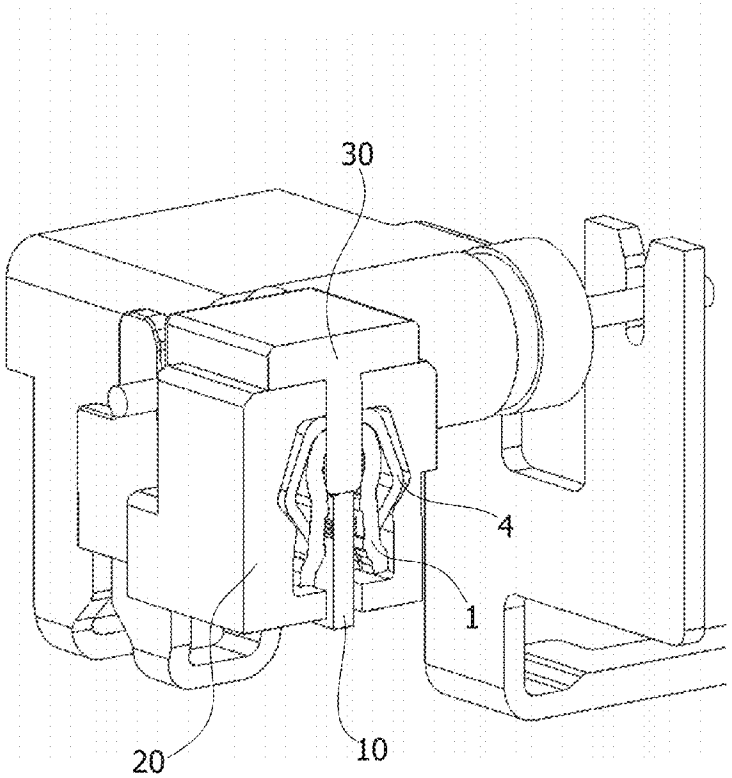
FIG. 5(*a*) is a perspective view of the connector, the resilient body, the housing, and the tool of FIG. 2 with a support.
Figure 5A:
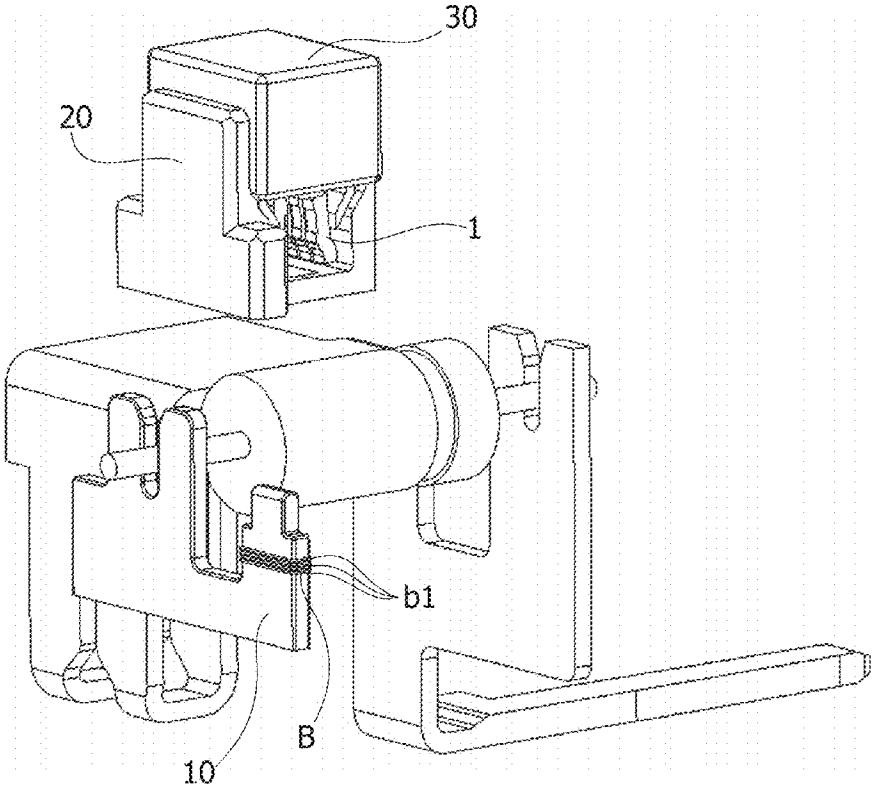

As shown in FIG. 5, the magnetic coil B is wound on a support 10. The coil B is formed by a plurality of turns b1. In the shown embodiment, a magnetic cable C that forms the coil B is a conducting cable covered by an insulating layer. The resilient body 1 is inserted on the support 10 of the coil B.

Prior to insertion on the support 10 of the coil B, shown in FIG. 5(*a*), the resilient body 1 must be brought into its open position by the tool 3 and kept open until the end of the insertion, so as to prevent the cutters 1*d* from coming into contact with the turns of the magnetic coil B during insertion. The thickness of the pins 3*e* are such as to move the end portions 1*b*1 of the arms 1*b* away from each other by a sufficient amount such that the cutters 1*d* do not come into contact with the turns b1 of the coil B during the insertion on the support 10.

In order to ensure that the resilient body 1 does not close too much and does not shear the cables b1 that form the coil B, the upper portions 1*g* come into contact with the support 10 of the coil B and further prevent the resilient body 1 closing during insertion. In the open position, the connecting portions 1*g* project further with respect to the inner walls of the central portion 1*c* and lock the resilient body 1 onto the support 10.

After the insertion of the resilient body 1 on the support 10 of the coil B, as shown in FIG. 5(*b*), the tool 3 is removed and the resilient body 1 closes onto the support 10, creating the electrical contact between the support 10 and the magnetic coil B. The resilient body 1 is biased into the closed position. Therefore, as soon as the stress imparted by the pin 3 is removed, the arms 1*b* move toward each other and come into contact with the coil B. The cutters 1*d* cut into the insulating layer of the magnetic cable C and come into contact with a conductor of the cable B. The support 10 is thus connected with the coil B by the resilient body 1, which is made of conductive material. The current therefore flows into the coil B and, via the cutters 1*d*, flows into the resilient body 1 which is in electrical contact with the support 10, closing the circuit. At the end of the closing operation, the resilient body 1 mechanically retains the winding of cable B on the support 10 and simultaneously creates an electrical contact between the support 10 and the winding of cable B.

Figures 2A, 2B, 2C, 2D:
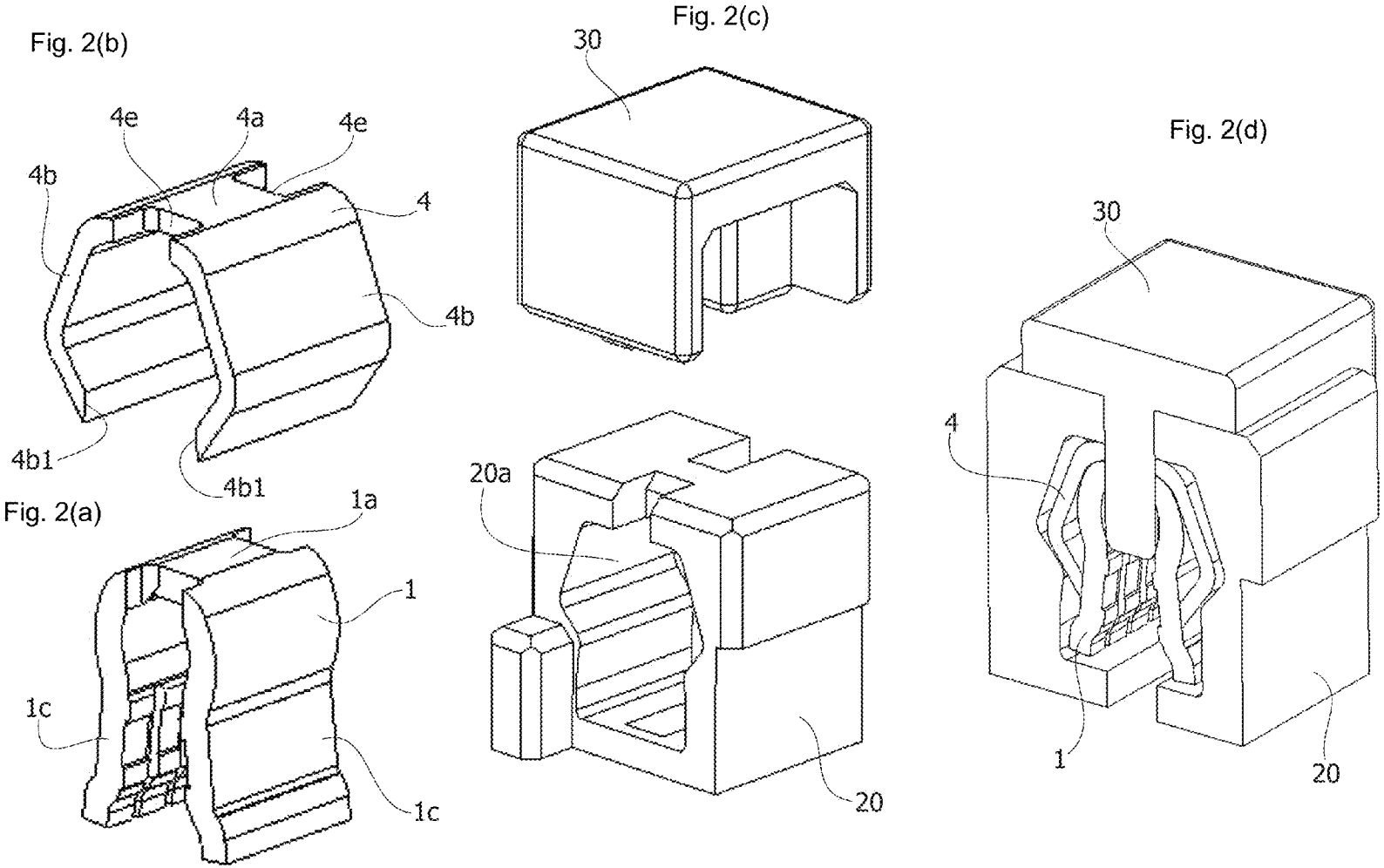
FIG. 2(*a*) is a perspective view of the connector of FIG. 1(*a*)

In another embodiment shown in FIG. 2, a second resilient body 4 is provided with the first resilient body 1 of FIG. 1.

As shown in FIG. 2, the second resilient body 4 is adapted to be fitted onto the first resilient body 1. The second resilient body 4 has a substantially U-shaped form comprising a connecting portion 4*a* from which two C-shaped arms 4*b* extend. The second resilient body 4 may also be stamped and formed from a plate of sheet metal.

The connecting portion 4*a* has a reduced longitudinal dimension with respect to the dimension of the arms 4*b* with two seats 4*e* arranged diametrically opposite relative to the connecting portion 4*a* and adapted to allow the pin 3*e* provided on the tool 3 to pass through. The second resilient body 4, when assembled on the first resilient body 1, has free ends 4*b*1 of the C-shaped arms 4*b* that engage external walls of the central portions 1*c* of the arms 1*b*, imparting a further force adapted to keep the first resilient body 1 in the closed position.

The second resilient body 4, as shown in FIG. 2, is inserted on top of the first resilient body 1 and the two elements thus assembled are inserted in a housing 20 similar to the housing 2 of FIG. 1. The housing 20 has a connector receiving space 20*a* for receiving the assembled first resilient body 1 and second resilient body 4 in their closed position. The connector receiving space 20*a* is formed so as to allow the opening of the first resilient body 1 prior to insertion on the support 10.

A tool 30 substantially similar to the tool 3, when inserted in the housing 20, brings the first resilient body 1 with the second resilient body 4 mounted thereon into the open position ready for insertion on the support 10. At the end of the insertion of the first resilient body 1 and second resilient body 4 on the support 10, the tool 30 is removed and the first resilient body 1 closes onto the support 10. The first resilient body 1 retains and forms the electrical contact between the support 10 and the magnetic coil B. The second resilient body 4 acts as a further security for preventing the first resilient body 1 from losing contact with the coil B in conditions subject to vibration.

Figure 3A:
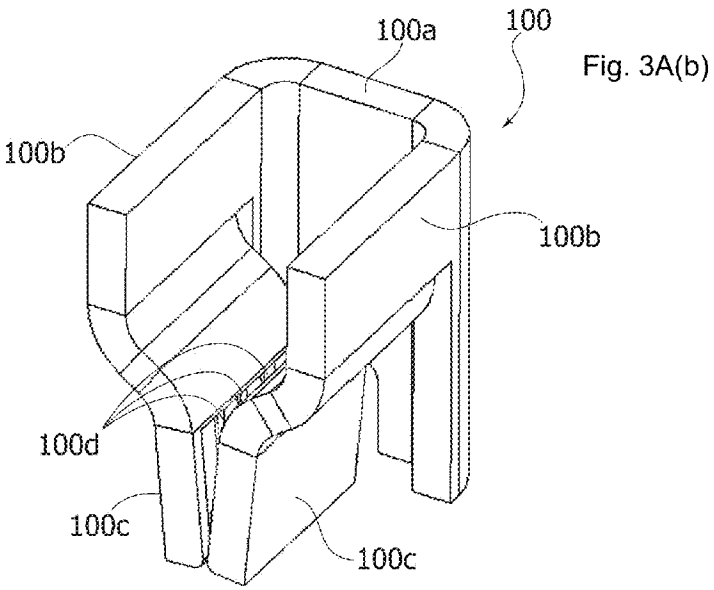
FIG. 3A(a) is a perspective view of a connector according to an embodiment of the invention.
Figure 3A:
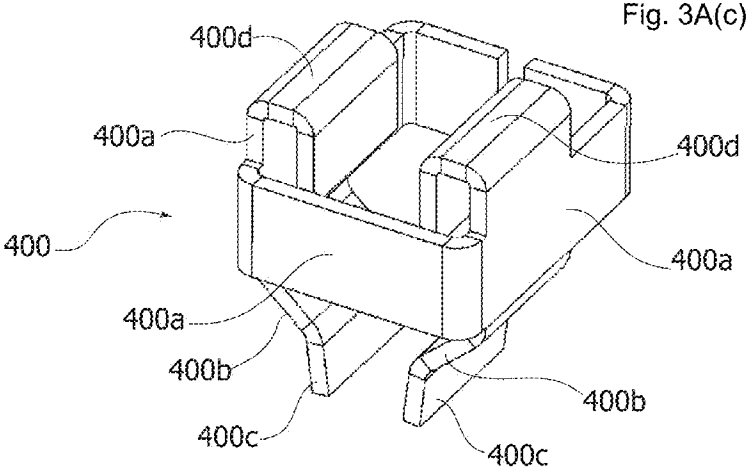
Figure 3A:
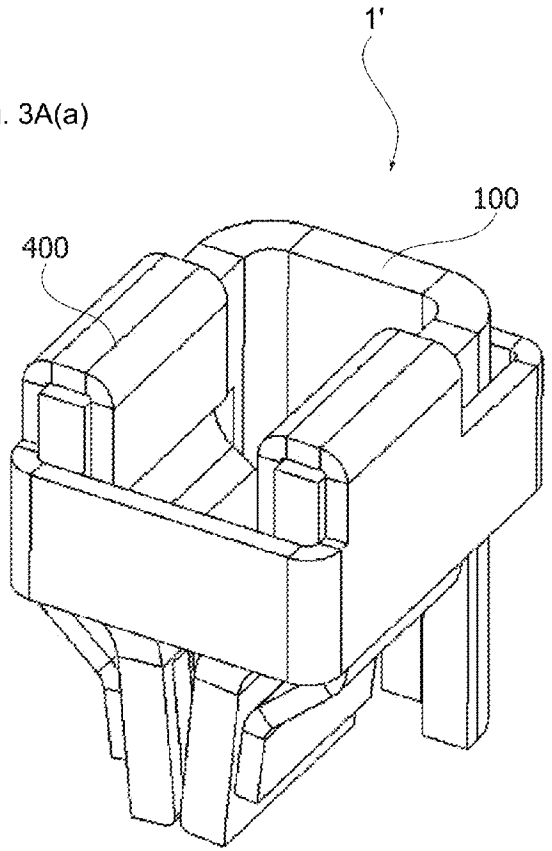
Figure 3A:
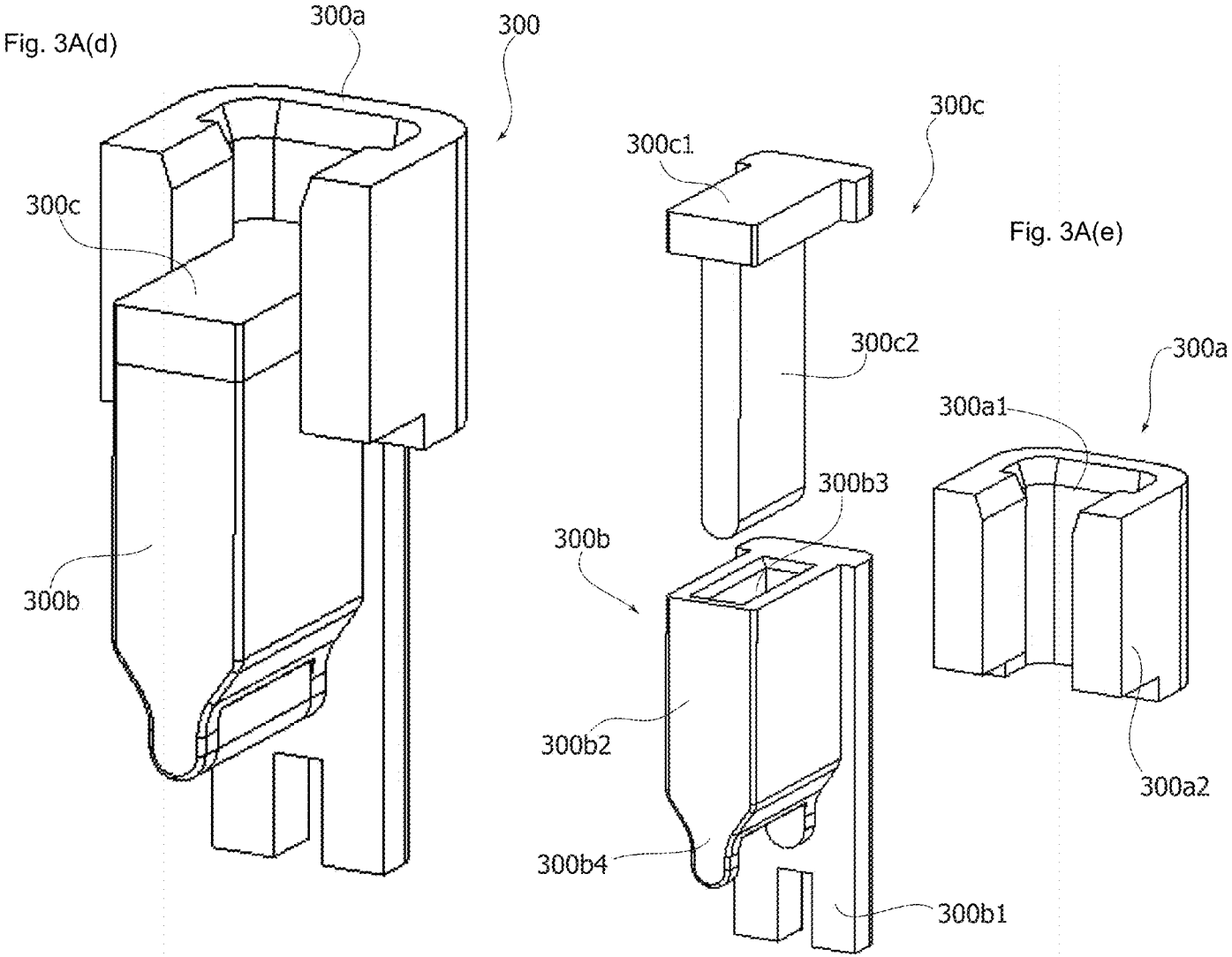

A connector 1' according to another embodiment of the invention is shown in FIG. 3A. The connector 1' includes a first resilient body 100 and a second resilient body 400.

The first resilient body 100, as shown in FIG. 3A(b), has a base wall 100*a* from which two support arms 100*b* extend orthogonally. Two folded and shaped retaining tongues 100*c* each extend from one support arm 100*b* in planes orthogonal to the plane of the base wall 100*a*. The first resilient body 100 may be formed by stamping and forming a plate of sheet metal. Cutters 100*d* are provided on the inner walls of the tongues 100*c*.

The second resilient body 400 may also be formed by stamping and forming a plate of sheet metal. The second resilient body 400 is adapted to be fitted onto the first resilient body 100 to form the connector 1', as shown in FIG. 3A(a), and has two opposite and spaced apart pressing tongues 400*b* that extend from two lateral base walls 400*a* as shown in FIG. 3A(c). An end portion 400*c* of the pressing tongues 400*b* is bent inwards to impart a further force adapted to keep the first resilient body 100 in the closed position by acting on the tongues 100*c*. The second resilient body 400 also comprises two brackets 400*d* bent so as to come into contact with and rest on the support arms 100*b*. Such brackets 400*d* extend from the lateral base walls 400*a* in the opposite direction to the two pressing tongues 400*b*.

A tool 300, as shown in FIGS. 3A(d) and 3A(e) brings the retaining tongues 100*c* of the first resilient body 100 into the open position to facilitate insertion of the connector onto the support 10 of the coil B. The tool 300 has three tool bodies 300*a*, 300*b* and 300*c* configured so as to be adapted to the geometry of the connector 1'.

As shown in FIGS. 3A(d) and 3A(e), the first tool body 300*a* guides and supports the second tool body 300*b*. During assembly, the first tool body 300*a* is positioned on the assembled connector 1' and has a guide groove 300*a*1 with a substantially C-shaped configuration. The second tool body 300*b* has a rear wall 300*b*1 adapted to be inserted and to slide within the groove 300*a*1. A box-shaped body 300*b*2 with smaller dimensions than the wall 300*b*1 extends from the wall 300*b*1. The box-shaped body 300*b*2 has a pin receiving space 300*b*3 that houses the third tool body 300*c* inside it. The third tool body 300*c* is formed by a T-shaped gripping portion 300*c*1 from which a pin 300*c*2 extends and is received in the pin receiving space 300*b*3. The box-shaped body 300*b*2 has two tapered ends 300*b*4 that facilitate its insertion in the connector 1'.

Figure 3B:
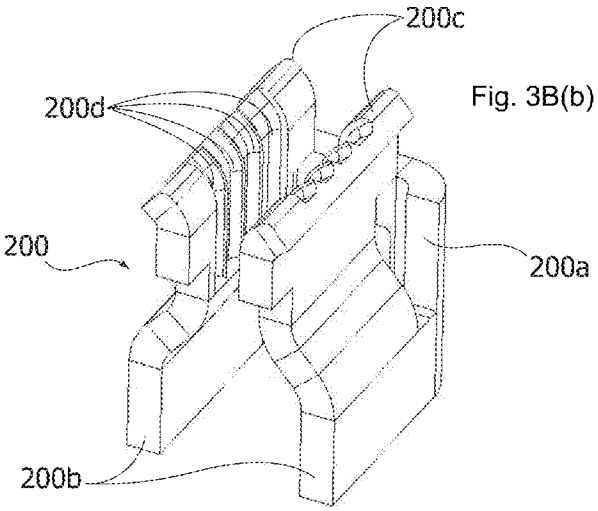
FIG. 3B(a) is a perspective view of a second resilient body of a connector according to an embodiment of the invention.
Figure 3B:
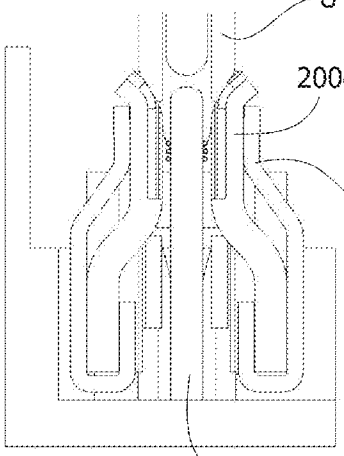
Figure 3B:
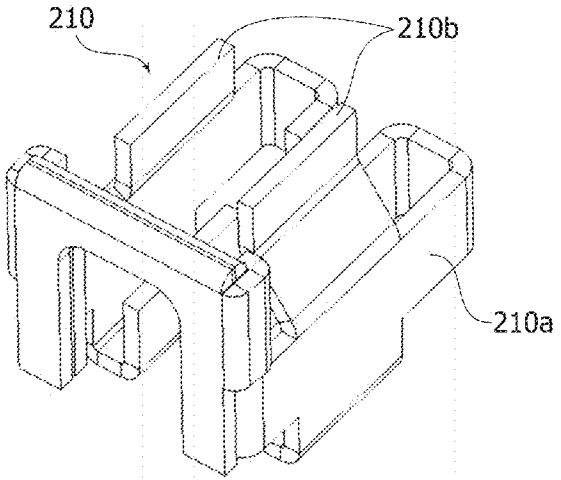
Figure 3B:
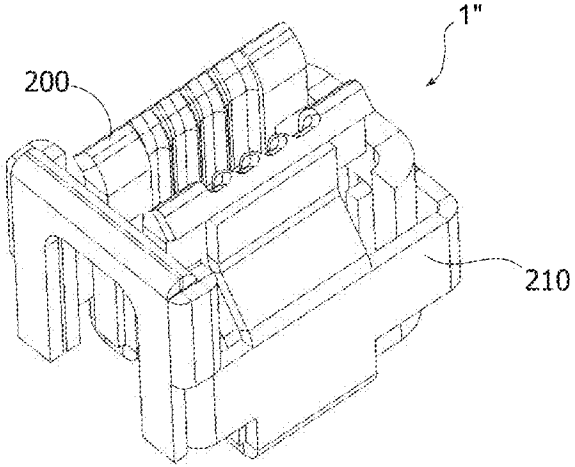

A connector 1" according to another embodiment of the invention is shown in FIG. 3B. The connector 1" comprises a first resilient body 200 and a second resilient body 210.

The first resilient body 200, shown in FIG. 3B(b) has a base wall 200*a* from which two support arms 200*b* extend orthogonally. Two folded and shaped retaining tongues 200*c* each extend from one support arm 200*b* in planes orthogonal to the plane of the base wall 200*a*. An end portion of the tongues 200*c* extends radially in order to facilitate the insertion of a tool UT, shown in FIG. 3B(d), for opening the first resilient body 200 prior to insertion on the support 10. Cutters 200*d* are disposed on the inner walls of the retaining tongues 200*c*. The first resilient body 200 may be formed by stamping and forming a plate of sheet metal.

The second resilient body 210, shown in FIG. 3B(a), may be formed by stamping and forming a plate of sheet metal. The second resilient body 210 is fitted on to the first resilient body 200 and has two opposite and spaced tongues 210*b* that extend from two lateral base walls 210*a*.

The first resilient body 200 and the second resilient body 210 are assembled into the connector 1", as shown in FIG. 3B(c). The assembled connector 1" is inserted onto the support body 10 as shown in FIG. 3B(d), with the retaining tongues 200*c* positioned upwards so that during insertion on the support 10 they are the last to reach the support 10. The embodiment shown in FIG. 3B allows a "head downwards" insertion of the connector 1", i.e. with the portion that performs the mechanical retention function and at the same time creates an electrical contact between the support 10 and the magnetic coil B situated at the top with respect to the drawings.

Figure 4B:
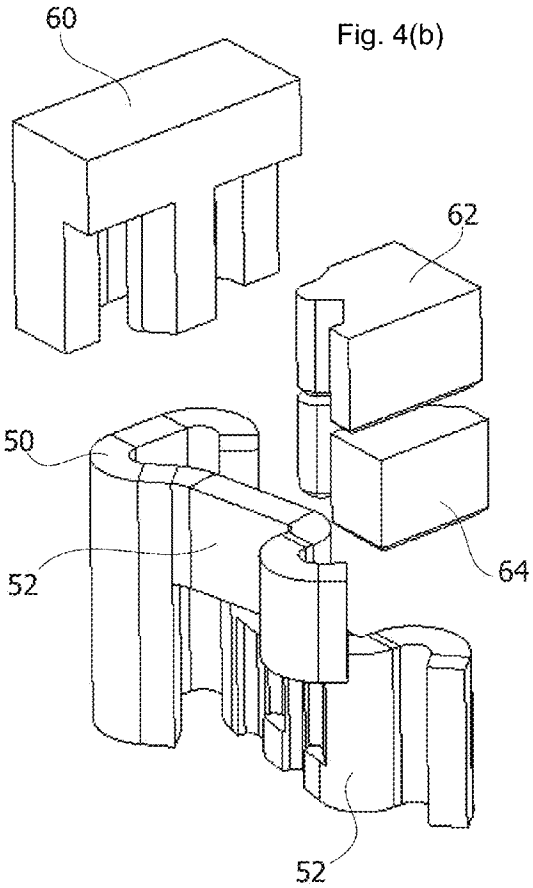
FIG. 4(*a*) is a perspective view of a connector according to an embodiment of the invention.
Figure 4A:
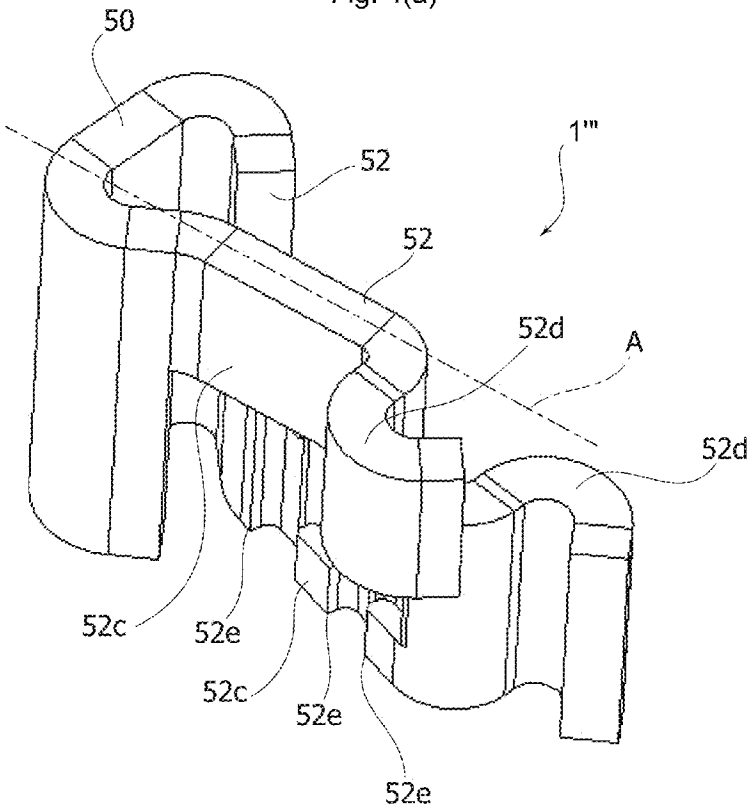

A connector 1'" according to another embodiment of the invention is shown in FIG. 4. The connector 1'", as shown in FIG. 4(*a*), comprises a connecting portion 50 from which two longitudinal arms 52 extend. The longitudinal arms 52 are vertically staggered and vertically have overall dimensions equal to the width of the connecting portion 50. In the closed position of the connector 1''', the longitudinal arms 52 are partially overlapped. Furthermore, each longitudinal arm 52 has a substantially flat central portion 52*c* and an S-shaped curved end portion 52*d* which extends radially with respect to axis A of the central portion 52*c*. Cutters 52*e* are only provided on one of the inner walls of the central portions 52*c* in the shown embodiment. Cutters 52*e* may alternatively be disposed on both walls.

A tool 60, shown in FIG. 4(*b*) is provided for keeping the connector 1''' open during insertion on the support 10. The tool 60 and two wedges 62, 64 move the two longitudinal arms 52 away from each other.

Figure 6B:
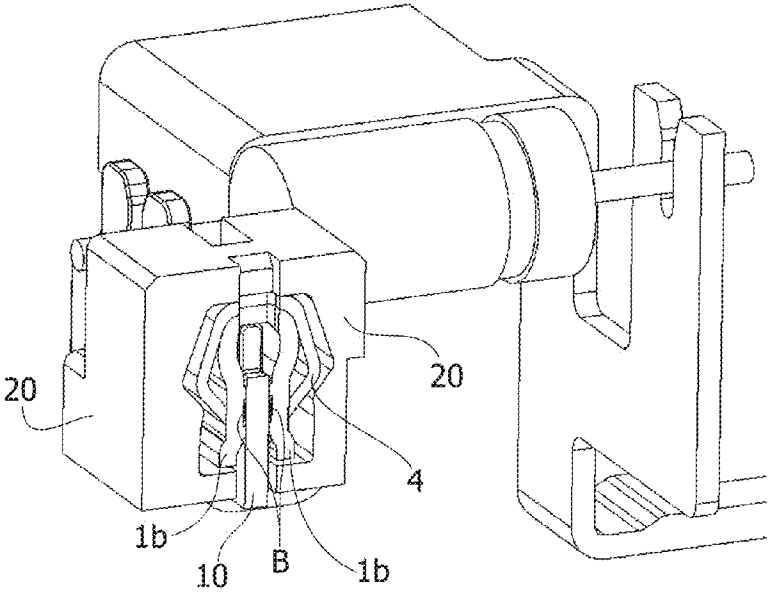
FIG. 6(*a*) is a sectional view of a perspective view of the connector, the resilient body, the housing, and the tool of FIG. 2 positioned on the support of FIG. 5(*a*)
Figure 6A:
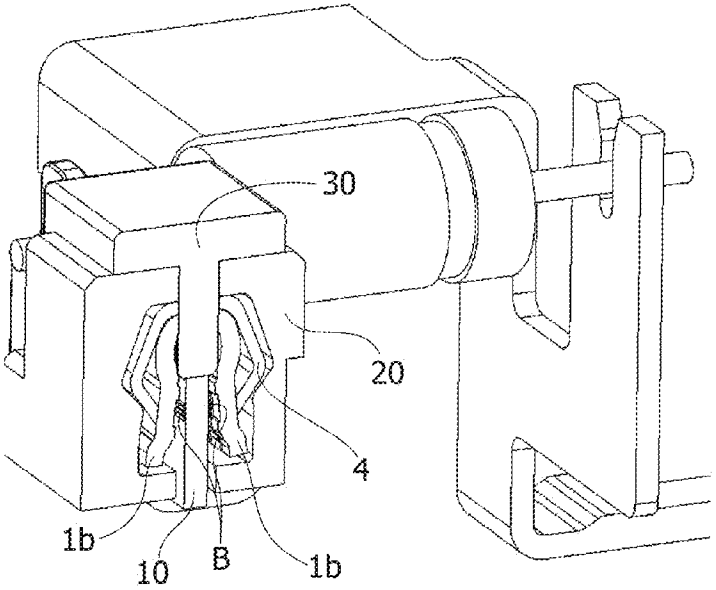
Figure 7C:
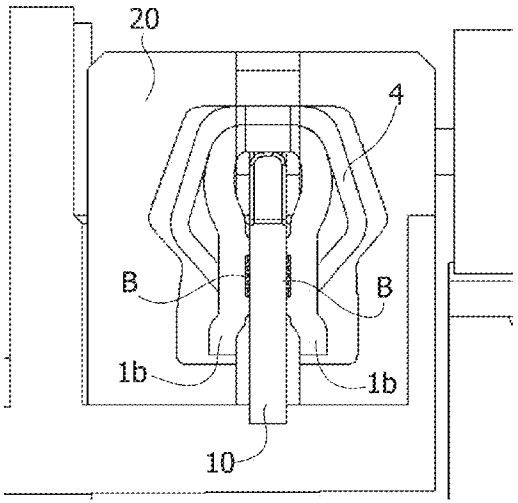
FIG. 7(*a*) is a sectional view of a contact between the connector and the resilient body of FIG. 2 and a coil of the support of FIG. 5(*a*)
Figure 7B:
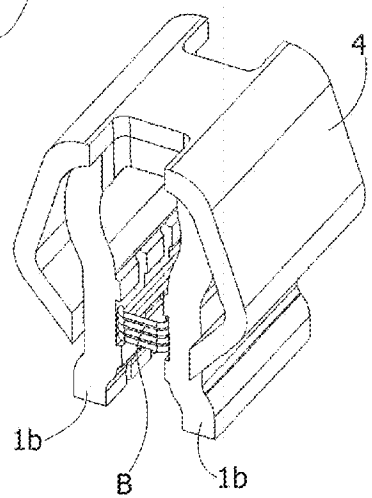
Figure 7A:
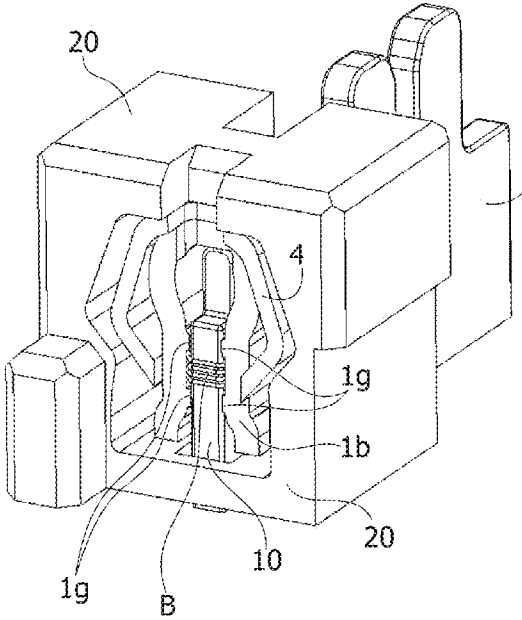
Figure 8A:
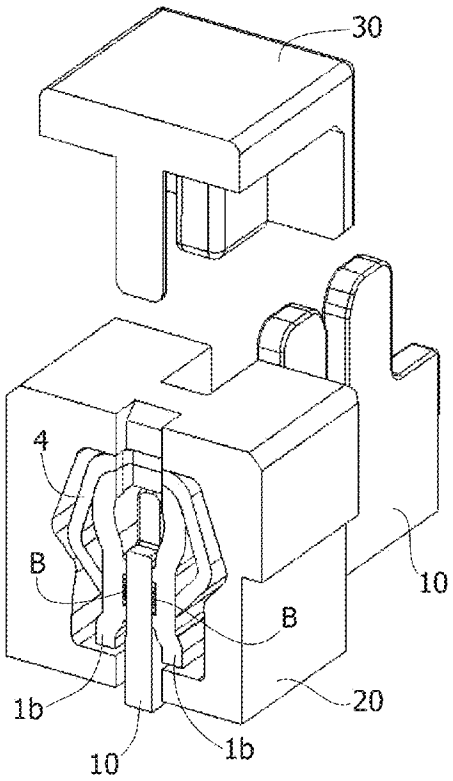
FIG. 8(*a*) is a sectional view of a contact between the connector and the resilient body of FIG. 2 and a coil of the support of FIG. 5(*a*)
Figure 8B:
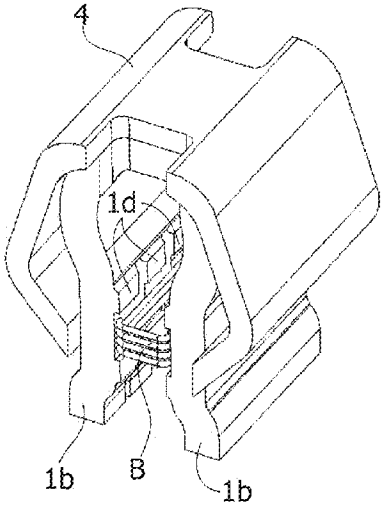
Figure 8C:
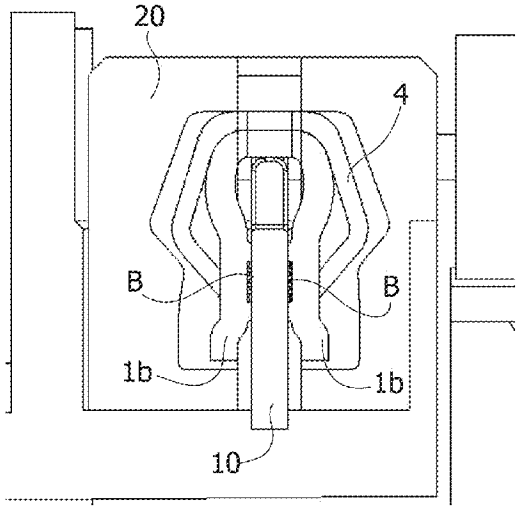
Figure 9B:
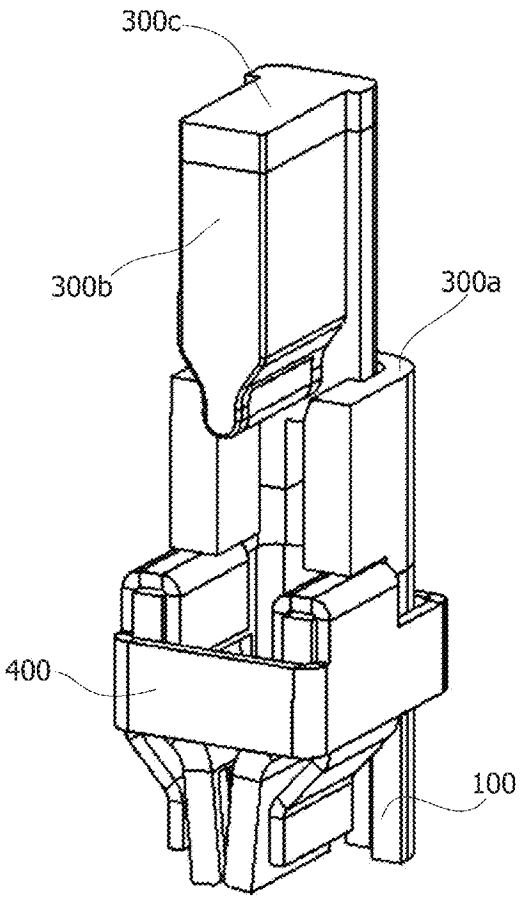
FIG. 9(*a*) is a perspective view of the connector and the tool of FIG. 3A.
Figure 9A:
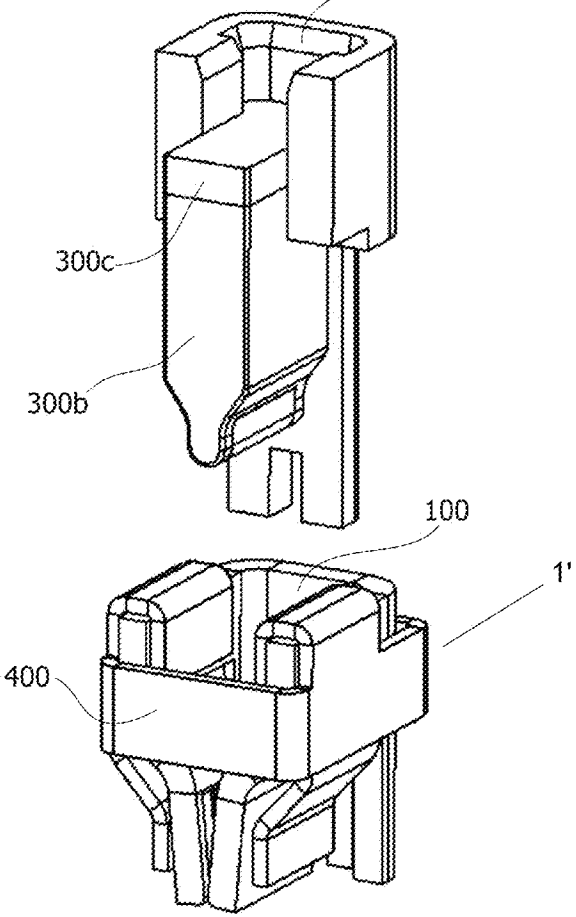
Figure 9D:
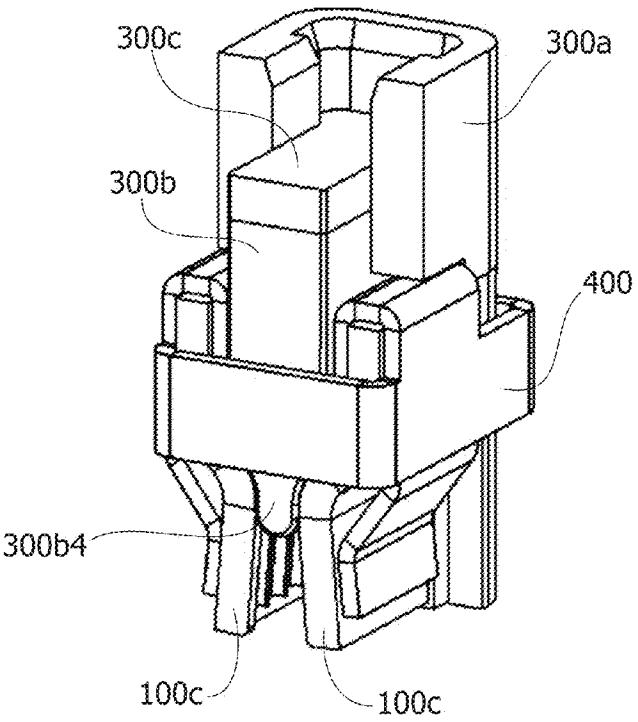
Figure 9C:
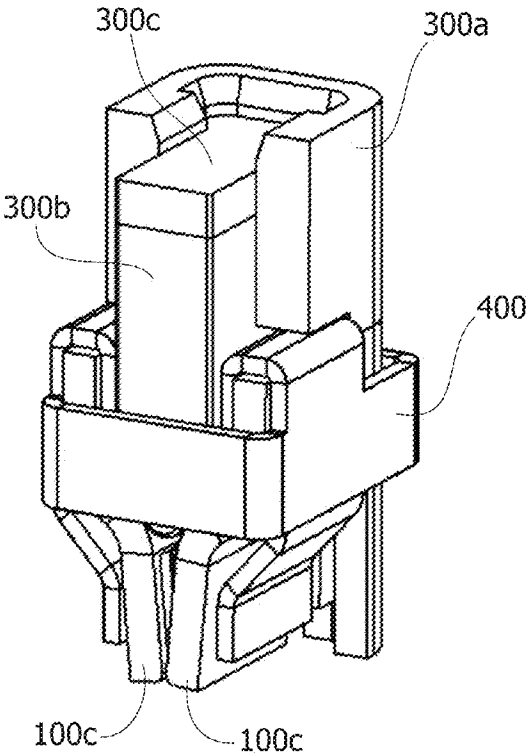

The steps of positioning the connector 1 of FIGS. 1 and 2 on the coil B wound onto the support 10 are shown in greater detail in FIGS. 5-8. In FIG. 5(*a*) the connector 1 is in its condition housed in the housing 20 and in the open position determined by the tool 30. In this figure the connector 1 is still uncoupled from the support 10. FIGS. 5(*b*) and 6(*a*) illustrate the subsequent step, in which the connector 1 is resting on the support 10. The arms 1*b* of the connector 1 are in their open position. FIG. 6(*b*) illustrates the final step in which the tool 30 has been removed from the housing 20 and the arms 1*b* of the connector 1 have been brought into the closed position creating the contact with the coil B. The resilient body 4 ensures that the connector 1 remains in the closed position. The contact of the connector 1 with the coil B is shown in greater detail in FIGS. 7 and 8.

Figure 10A:
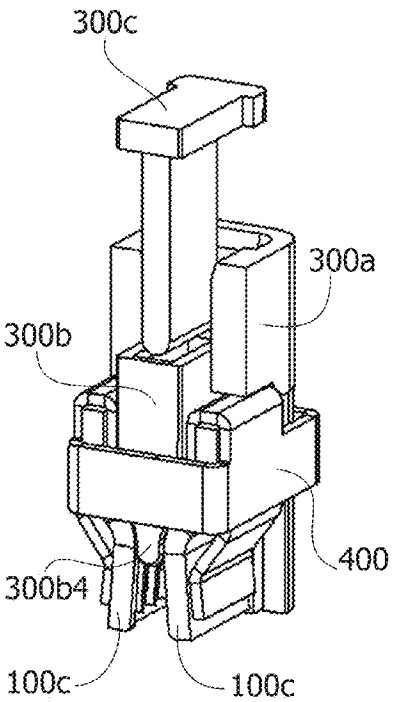
FIG. 10(*a*) is a perspective view of the connector and the tool of FIG. 3A.
Figure 10B:
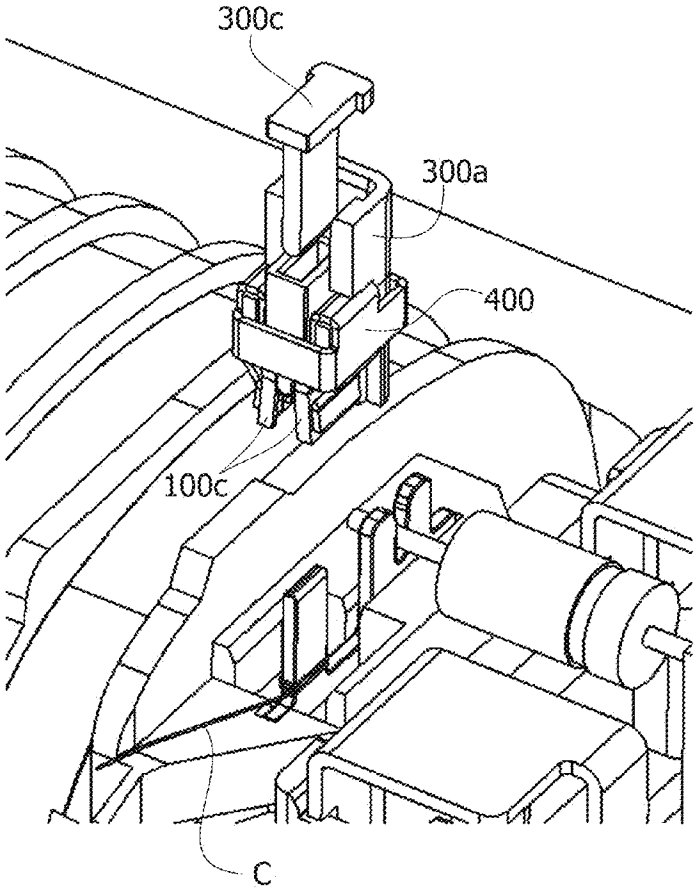
Figure 10C:
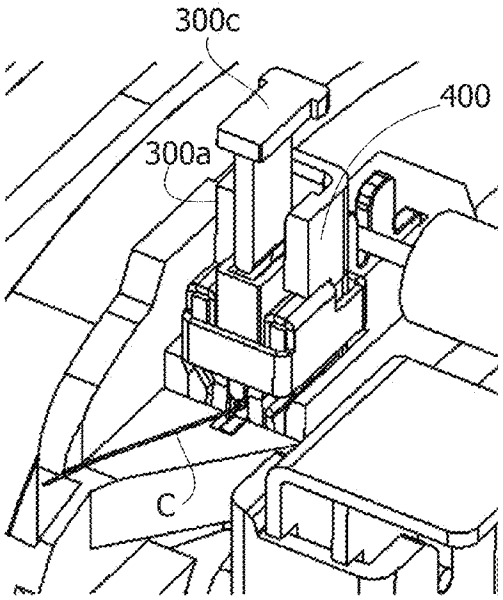
Figures 11A, 11B, 11C, 11D:
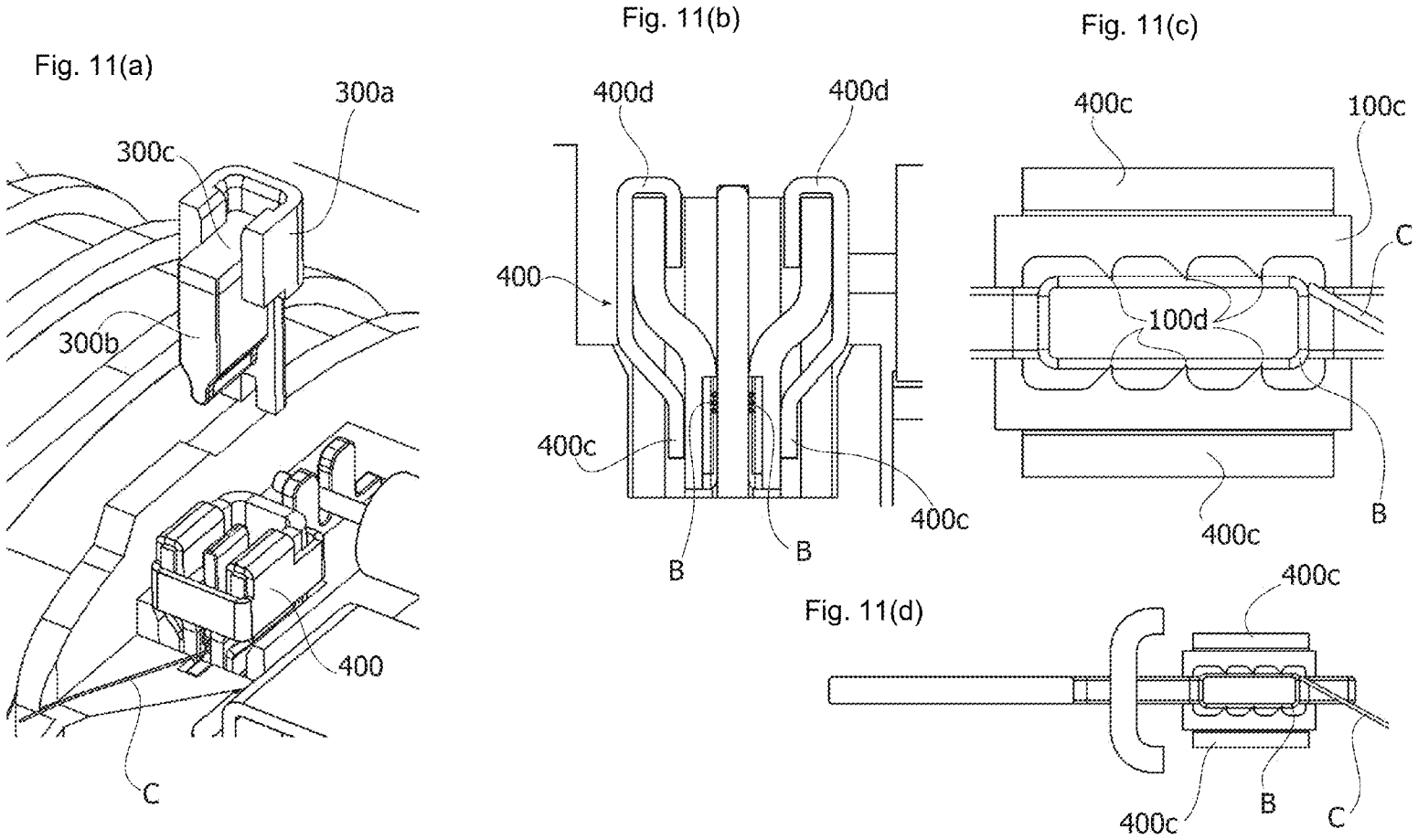
FIG. 11(*a*) is a perspective view of the connector and the tool of FIG. 3A and the cable of FIG. 10.
Figure 12B:
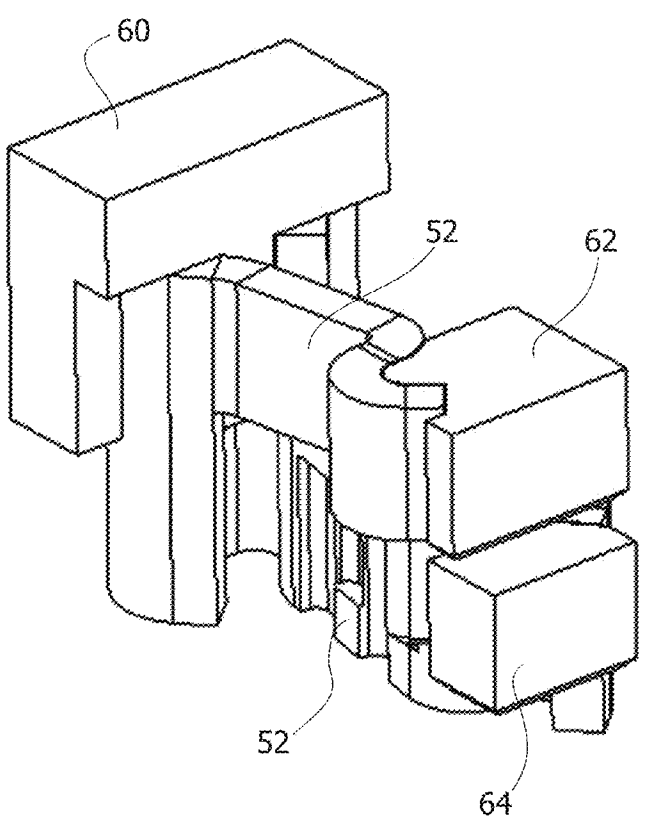
FIG. 12(*a*) is a perspective view of the connector and the tool of FIG. 4.
Figure 12A:
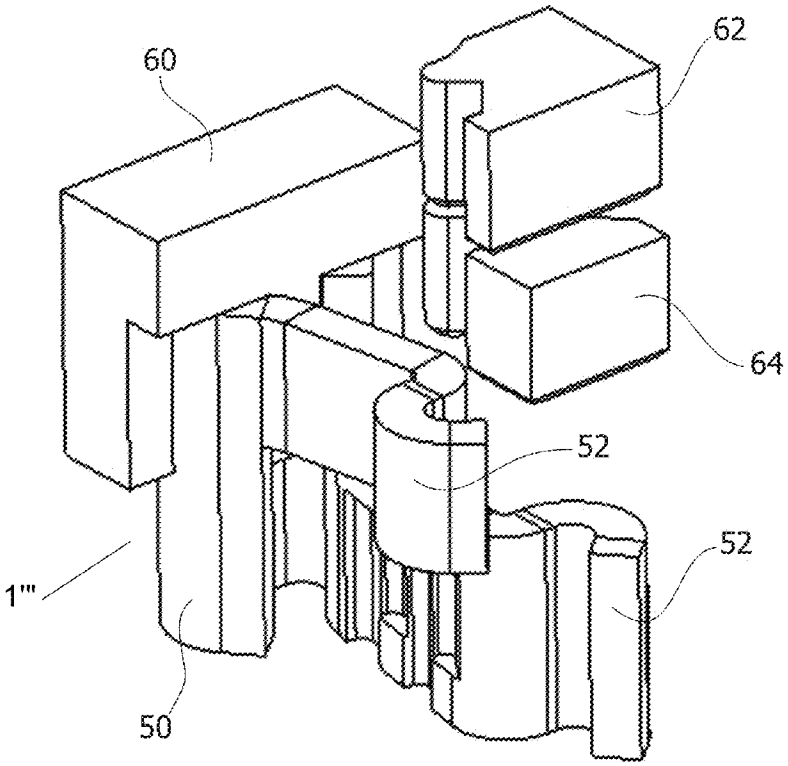
Figure 12D:
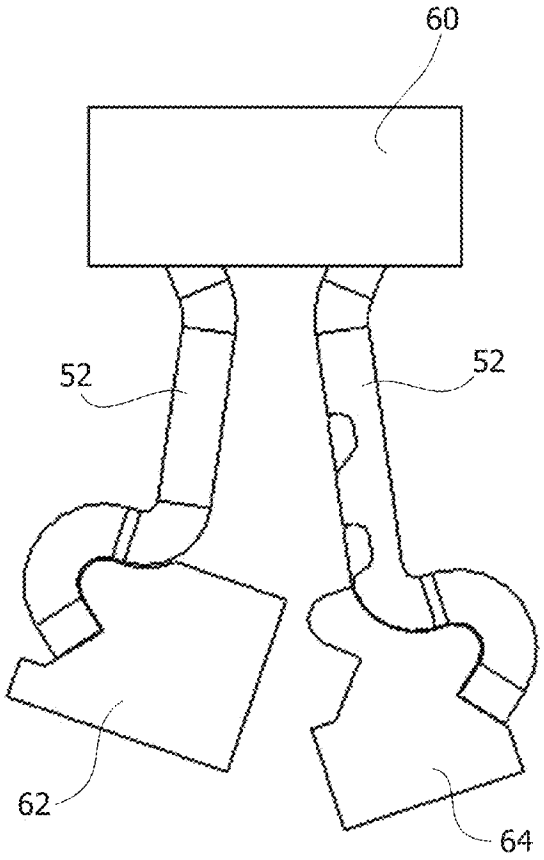
Figure 12C:
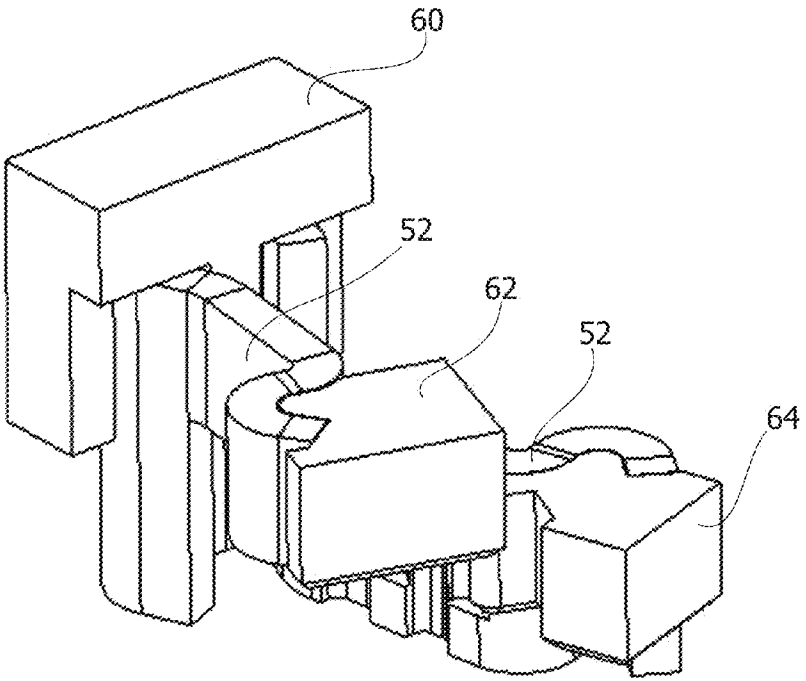

The steps of positioning the connector 1' of FIG. 3A on the coil B are shown in greater detail in FIGS. 9-11. As shown in FIGS. 9(*a*)-9(*d*), the first tool body 300*a* is inserted into the connector 1' and the second tool body 300*b* and third tool body 300*c* are moved with respect to the first tool body 300 along the guide groove 300*a*1. The second tool body 300*b* moves the tongues 100*c* apart by a sufficient amount such that the cutters 100*d* do not come into contact with the turns b1 of the coil B during the insertion on the support 10. The tapered portions 300*b*4 keep the tongues 100*c* spaced apart. FIG. 9(*d*) shows the connector in its open position ready to be inserted on the coil B.

The insertion of the connector 1' in the open position onto the coil B is shown in FIGS. 10 and 11. After the insertion of the connector 1' on the support 10 of the coil B, as shown in FIGS. 10(*c*) and 11(*a*), the tool 300 is removed and the connector 1' closes onto the support 10, creating the electrical contact between the support 10 and the magnetic coil B. As shown in FIGS. 11(*b*)-11(*d*), the cutters 100*d* cut into the insulating layer of the magnetic cable C and come into contact with a conductor of the cable B. The support 10 is thus connected with the coil B by the connector 1', which is made of conductive material. The current therefore flows into the coil B and, via the cutters 100*d*, flows into the connector 1' which is in electrical contact with the support 10, closing the circuit. At the end of the closing operation, the connector 1' mechanically retains the winding of cable B on the support 10 and simultaneously creates an electrical contact between the support 10 and the winding of cable B. The second resilient body 400 ensures that the first resilient body 100 remains in the closed position.

Figures 13A, 13B:
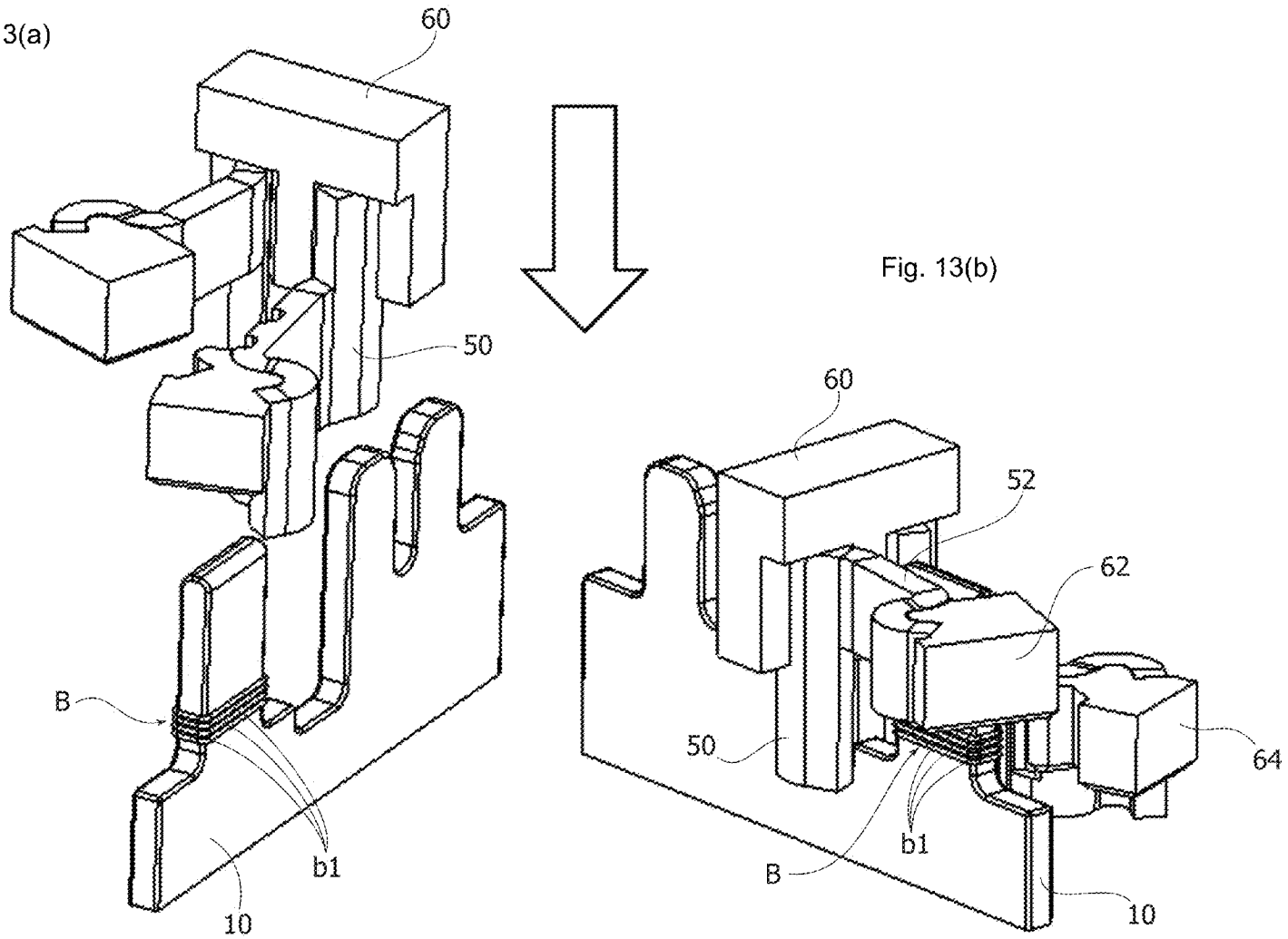
FIG. 13(*a*) is a perspective view of the connector and the tool of FIG. 4 and a coil of a support.
Figure 13D:
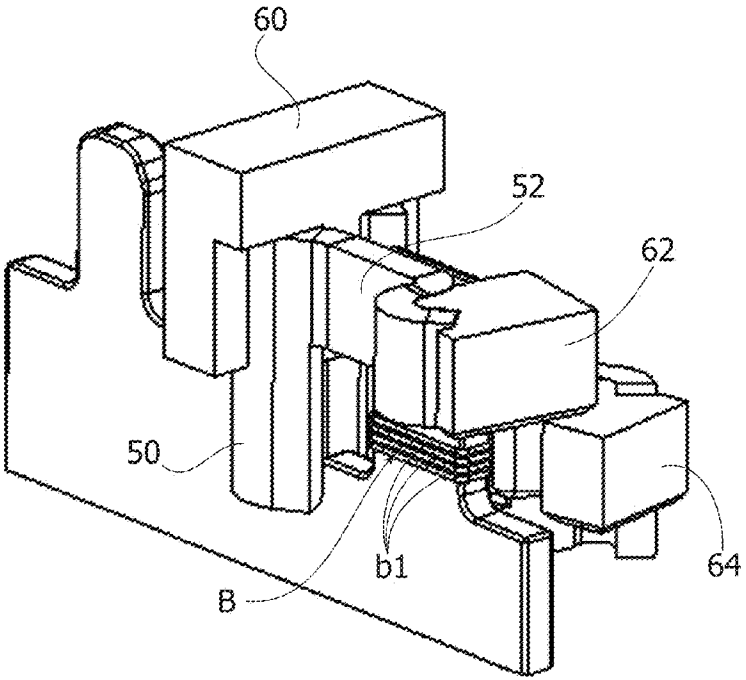
Figure 13C:
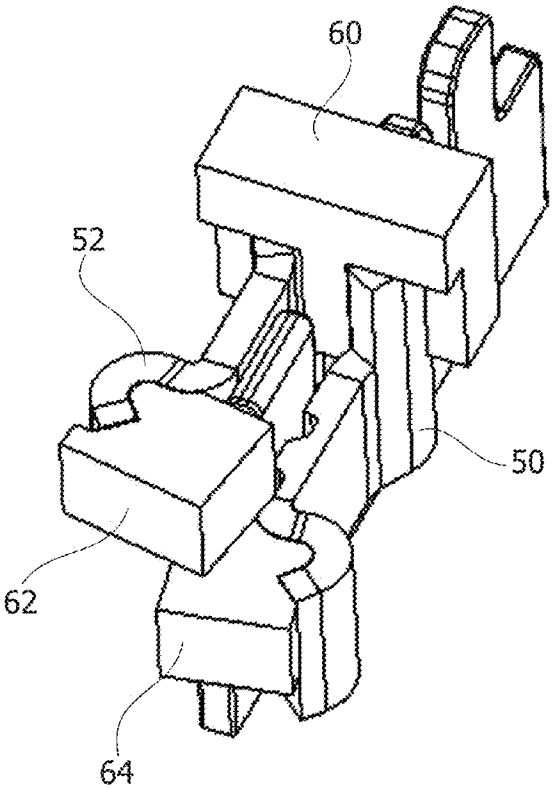

The steps of positioning the connector 1''' of FIG. 4 on the coil B are shown in greater detail in FIGS. 12 and 13. As shown in FIGS. 12(*a*)-12(*d*), the tool 60 and the wedges 62, 64, are inserted between the longitudinal arms 52 to space apart the longitudinal arms 52. FIG. 12(*d*) shows the connector 1''' in the open position.

Figure 14B:
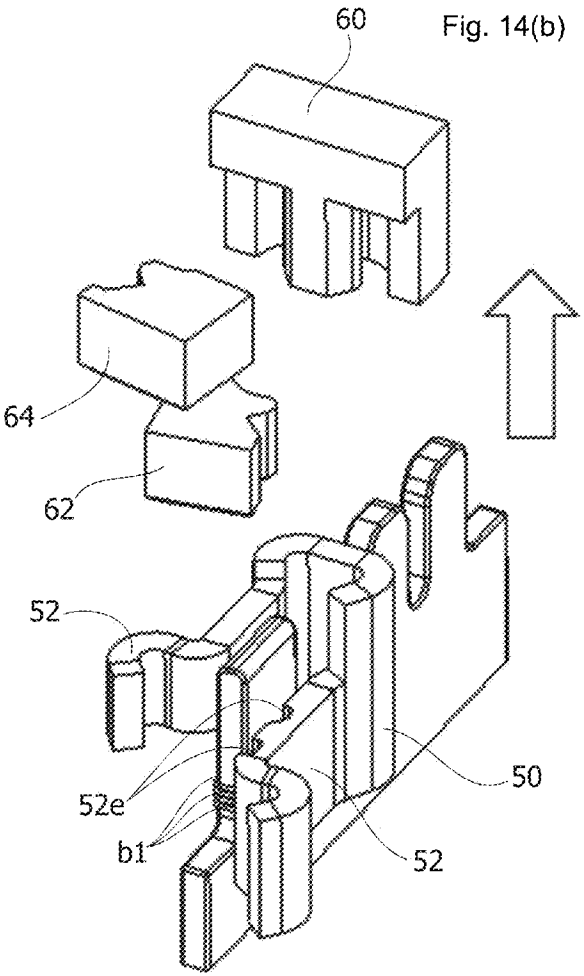
FIG. 14(*a*) is a perspective view of the connector and the tool of FIG. 4 and the coil.
Figure 14A:
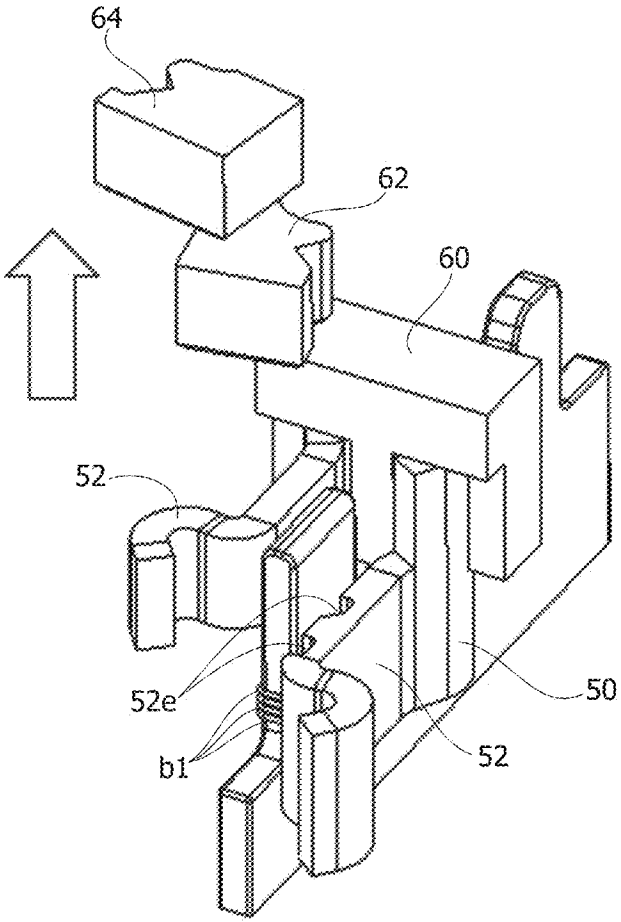
Figure 15C:
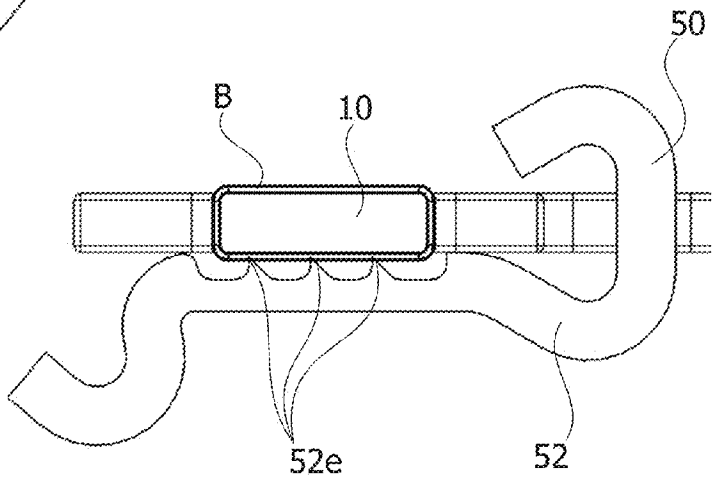
FIG. 15(*a*) is a perspective view of a contact between the connector of FIG. 4 and the coil.
Figure 15B:
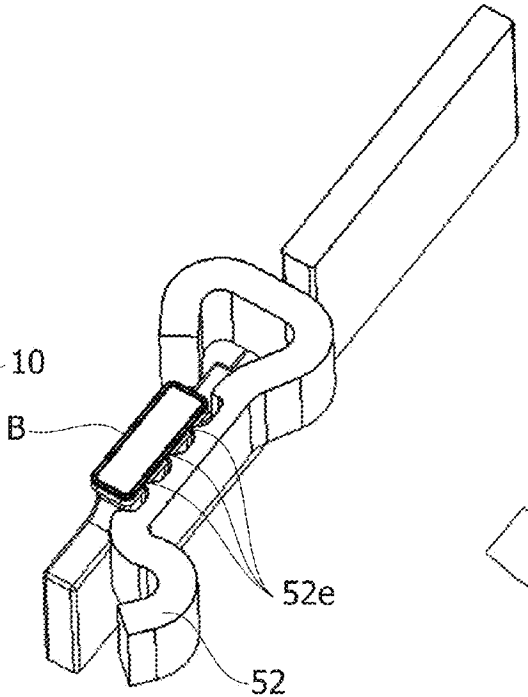
Figure 15A:
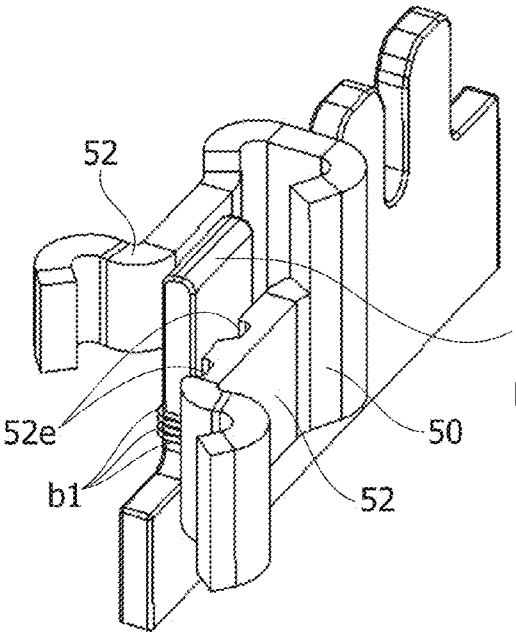

The insertion of the connector 1''' in the open position onto the coil B is shown in FIG. 13. As shown in FIG. 14, the tool 60 and wedges 62, 64, are removed and the longitudinal arms 52 move toward each other and close on the support 10 and coil B. The cutters 52*e* as shown in FIG. 15, cut into the insulating layer of the magnetic cable C and come into contact with a conductor of the cable B. The support 10 is thus connected with the coil B by the connector 1''', which is made of conductive material. The current therefore flows into the coil B and, via the cutters 52*e*, flows into the connector 1''' which is in electrical contact with the support 10, closing the circuit. At the end of the closing operation, the connector 1''' mechanically retains the winding of cable B on the support 10 and simultaneously creates an electrical contact between the support 10 and the winding of cable B.

What is claimed is:

1. A connector for connecting to a magnetic coil wound onto a support, comprising:

a first resilient body formed of a conductive material and having a plurality of cutters disposed on a plurality of inner walls of the first resilient body, the first resilient body inserted onto the support and held in an open position during insertion, the first resilient body biased into a closed position in which the plurality of cutters cut an insulating layer on the magnetic coil and the first resilient body retains the magnetic coil on the support while electrically connecting the magnetic coil and the support.

2. The connector of claim 1, wherein the first resilient body has upper portions contacting the support and preventing the first resilient body from moving into the closed position during insertion.

3. The connector of claim 1, further comprising a tool holding the first resilient body in the open position.

4. The connector of claim 1, wherein the plurality of cutters do not contact the magnetic coil in the open position of the first resilient body.

5. The connector of claim 1, wherein the first resilient body is formed by stamping and forming a plate of sheet metal.

6. The connector of claim 1, wherein the first resilient body is substantially U-shaped.

7. The connector of claim 6, wherein the first resilient body has a first connecting portion from which a pair of opposite and spaced apart first arms extend.

8. The connector of claim 7, wherein each first arm has a central portion projecting towards the other arm and reducing a distance between the pair of first arms.

9. The connector of claim 8, wherein the central portion of each first arm contacts the support.

10. The connector of claim 9, wherein the plurality of cutters are disposed on an inner wall of at least one central portion.

11. The connector of claim 10, further comprising a second resilient body fitted on the first resilient body, the second resilient body is substantially U-shaped and has a second connecting portion from which a pair of C-shaped second arms extend.

12. The connector of claim 11, wherein each of the second arms has a free end engaging an external wall of the central portion of one first arm to further bias the first resilient body into the closed position.

13. The connector of claim 9, further comprising a housing having a connector receiving space, the first resilient body disposed in the connector receiving space.

14. The connector of claim 13, further comprising a tool inserted into the housing and holding the first resilient body in the open position.

15. The connector of claim 1, wherein the first resilient body has a base wall from which a pair of support arms extend orthogonally and a pair of folded and shaped retaining tongues each extending from one support arm in a direction orthogonal to a plane of the base wall.

16. The connector of claim 15, wherein the plurality of cutters are disposed on an inner wall of each retaining tongue.

17. The connector of claim 16, further comprising a second resilient body fitted on the first resilient body, the second resilient body having a pair of opposite and spaced apart pressing tongues.

18. The connector of claim 17, wherein an end portion of each of the pressing tongues engages one retaining tongue to further bias the first resilient body into the closed position.

19. The connector of claim 1, wherein the first resilient body has a connecting portion from which a pair of longitudinal arms extend, the pair of longitudinal arms are staggered with respect to each other.

20. The connector of claim 19, wherein the pair of longitudinal arms partially overlap in the closed position of the first resilient body.

21. The connector of claim 20, wherein each longitudinal arm has a substantially flat central portion and an S-shaped end portion extending radially with respect to a longitudinal axis of the central portion.

22. The connector of claim 21, wherein the plurality of cutters are disposed on an inner wall of at least one central portion.

23. The connector of claim 1, wherein the plurality of cutters are parallel to one another and extend in a direction orthogonal to a longitudinal direction of the first resilient body.

24. The connector of claim 23, wherein the plurality of cutters are formed by broaching, milling, or plastic deformation.

* * * * *